United States Patent [19]

Herzog

[11] 4,429,722

[45] Feb. 7, 1984

[54] METHOD AND APPARATUS FOR WEAVING FABRICS OF NOVEL CONSTRUCTION

[75] Inventor: Earl E. Herzog, Greenville, R.I.

[73] Assignee: Quaker Fabric Corp., Fall River, Mass.

[21] Appl. No.: 264,534

[22] Filed: May 18, 1981

[51] Int. Cl.[3] ..... D03C 7/06

[52] U.S. Cl. ..... 139/48; 139/49

[58] Field of Search ..... 139/46, 47, 48, 49, 139/50

[56] References Cited

U.S. PATENT DOCUMENTS

| | | | |
|---|---|---|---|
| 566,551 | 8/1896 | Veyron | 139/49 |
| 2,542,677 | 2/1951 | Kane | 139/49 |
| 3,042,081 | 7/1962 | Maelssac et al. | 139/46 |

FOREIGN PATENT DOCUMENTS

| | | | |
|---|---|---|---|
| 28698 | 9/1884 | Fed. Rep. of Germany | 139/49 |
| 579162 | 8/1976 | Switzerland | 139/48 |
| 8512 | of 1899 | United Kingdom | 139/49 |
| 2510 | of 1914 | United Kingdom | 139/49 |

*Primary Examiner*—Henry Jaudon

*Attorney, Agent, or Firm*—Salter & Michaelson

[57] ABSTRACT

Method and apparatus are disclosed for weaving fabrics on a loom wherein, during the usual operation of the loom, specially arranged warp yarns, hereinafter called "decorating yarns" advancing from separate warp yarn supplies which are remote from the normal warp beam, are caused to cross over the normal warp yarns during shedding. The decorating yarns are under the control of unique heddles mounted in harnesses which are arranged for both sideways or lateral movement and also adapted for up and down movement. The unique heddles and harnesses are controlled in synchronism with the normal shedding of the loom so that the specially arranged decorating yarns are caused to cross over the usual warp yarns and then be projected into the shed to be held in place as the filling is projected through the shed and beat-up. Thus, the decorating yarns, which may vary from the usual warp yarns in any desired manner as, for example, count, color, fiber composition, etc., and may diverse with respect to each other, are locked into the fabric woven on the loom as an integral part of that fabric. Mechanism is provided for programming both the lateral and horizontal movements of the harnesses carrying the unique heddles to permit formation of woven fabrics possessing a wide variety of constructions consistent with the manner in which the aforesaid special harnesses and heddles are operated in relationship to the normal weaving operation of the loom.

30 Claims, 13 Drawing Figures

METHOD AND APPARATUS FOR WEAVING FABRICS OF NOVEL CONSTRUCTION

BACKGROUND OF THE INVENTION

The present invention relates to the art of weaving fabrics and relates, more particularly, to method and apparatus for weaving fabrics of novel construction wherein pattern forming in the fabric is accomplished simultaneously with formation of the fabric.

Conventional looms for weaving fabrics wherein two sets of yarns are interlaced at right angles to each other are old and well known in the art. In these looms warp yarns are led from a beam of such warp yarns, the warp yarns generally moving as a sheet of parallel yarns and constituting a first set of yarns. The second "set of yarns" so-called, may actually be but a single yarn called "filling". The filling is laid between the warp yarns in an area of the loom commonly called the shed. In the shed the warp yarns are divided by the action of the harnesses which alternately raise and lower various of the warp yarns so that a V-opening constituting the shed is formed. The filling is projected through the shed, usually one pick at a time, and at right angles to the warp yarns. In accordance with the present invention, projection of the filling as just described may be by any of a variety of means such as air, water or a so-called sword or rapier which carries the yarn mechanically through the shed. After the filling is inserted across the shed, a comb-like member, the reed, is thrust forward to beat the filling into the fabric.

The reed is fixed to a lay mechanism operating in an oscillating motion forward and backwards. As the fabric is formed, the warp is unwound from the beam by let-off mechanism. This is associated with winding of the woven fabric on a cloth roll or take-up. The shed formation alluded to above, in a simple weave, will repeat every two cycles. That is to say, the warp yarns of the sheet are lead through the heddles of the harnesses with ever other warp yarn passing through a first of the harnesses and the intervening warp yarns passing through a second harness. Each of the harnesses is alternately raised and lowered so that when one of the harnesses is in it top position the other harness is in its lower position. When the harnesses are in their maximum upper and lower positions, the shed is fully open and the sheet of warp yarns which in shedding is, in fact, two sheets one passing through the first harness and the other being guided by the second harness are separated to form a V-shaped tunnel or shed through which the filling is projected. After the filling has been inserted through the shed, the harnesses simultaneously shift to respective upper and lower positions so that the two warp sheets become level with each other while the reed is abruptly moved forward to beat up the filling, i.e., to push the filling into the fabric at the fell of the fabric.

In conventional looms of the type just described in general terms, it has long been desired that an element of versatility be introduced so that varied fabrics can be woven. The present invention admirably meets this objective. In the present invention otherwise conventional looms incorporate mechanism which permits the weaving of decorative patterns into fabrics simultaneously with the formation of the fabrics, the patterns being present as an integral part of the completed fabric.

OBJECTS OF THE INVENTION

It is one object of the present invention to provide method and means for weaving fabrics wherein, during normal fabric formation, a pattern of a diverse yarn is simultaneously formed in the fabric as an integral part thereof.

Another object of the invention is to provide a harness motion control which is operable both in reciprocating horizontal and vertical directions to introduce diverse warp yarns into the shed of a loom with the diverse yarns crossing certain of the warp yarns advancing from the warp beam and being beat into the fabric in said crossed position simultaneously with the warp yarns advancing from said beam.

Still a further object of the present invention is to provide method and apparatus for weaving fabric wherein a loom incorporates harnesses having programmable vertical and horizontal motions to thereby prescribe the weaving of fabrics having a variety of patterns woven into the fabrics as an integral part thereof.

Other objects, features and advantages of the invention will become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE INVENTION

Figure 1:
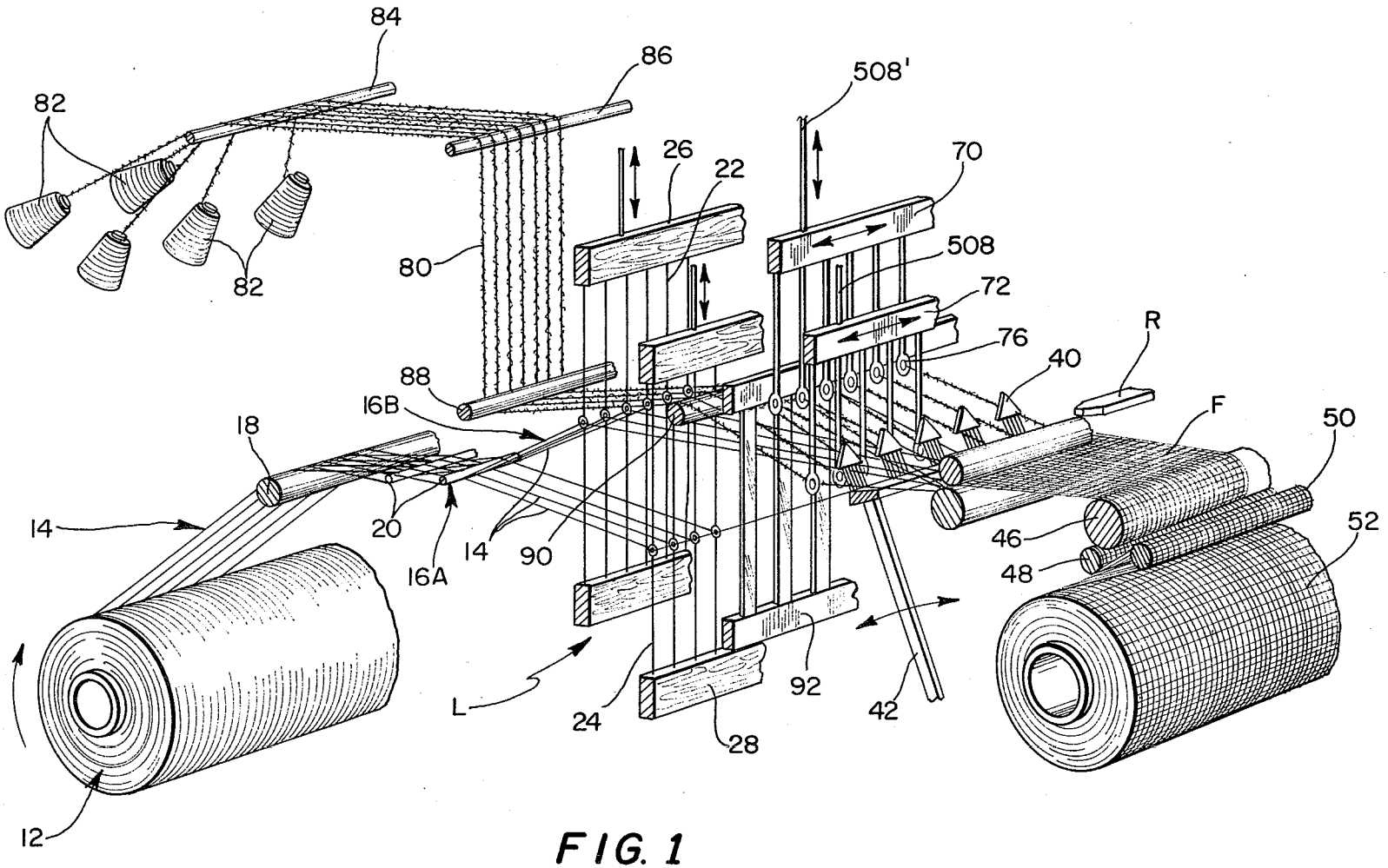
FIG. 1 is a perspective view of a loom incorporating the improvements of the present invention.
Figure 2:
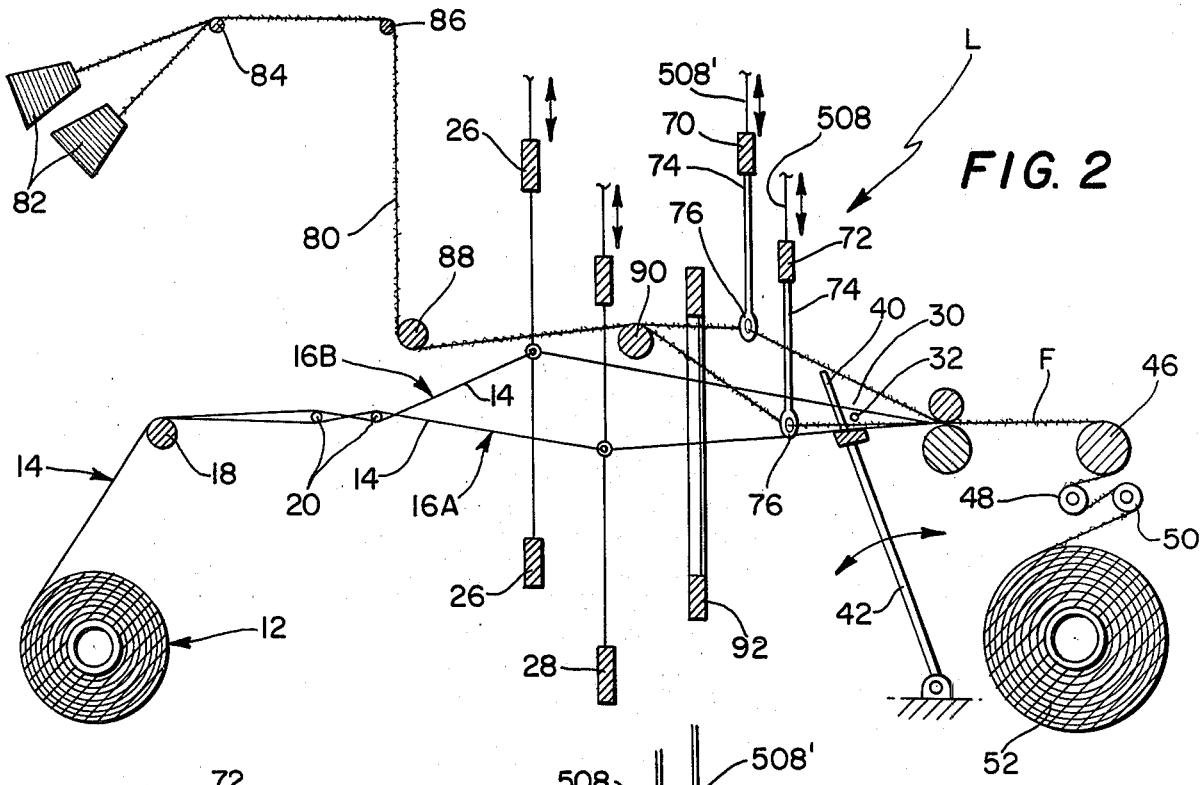
FIG. 2 is a side elevational view of the loom of FIG. 1.

Referring now to the drawing in detail and with initial reference to FIGS. 1 and 2, a loom L is illustrated which may be of the type known as the Universal Iwer Shuttleless Weaving Machine Type 1800 manufactured by Maquinaria Textile del Norte de Espana S.A., Pamplona, Spain. Loom L includes the usual warp beam 12 located at a position generally regarded as the rear of loom L. Beam 12 includes a series of individual warp yarns 14 which are delivered from beam 12 in a sheet. The warp yarns 14 move over a series of guide rods 18 and lease rods 20 which control the movement of the warp yarns forwardly and maintain the warp yarns from cross over each other during their advance. Warp yarns 14 are divided into two sheets 16A and 16B as they pass into the control of separate sets of heddles 22 and 24 supported in respective harnesses 26 and 28. In the known manner, harness 26 is operated in a relatively simple weave to be in an elevated position while harness 28 is in its lower position, and vice versa, as shown in FIG. 1. This results in the two sheets of warp yarns 16A and 16B forming a V-shaped tunnel or passage in the zone which, for convenience herein, will be called the shedding zone 30. In the shedding zone 30, one or more filling yarns 32 are intermittently inserted across the shedding zone say, by means of rapier R, and are beat up into the fell of fabric F. Throughout the weaving cycle, harnesses 26 and 28 are alternately raised and lowered through conventional shedding control means such as a dobby mechanism to be described hereinafter. As the harnesses are cycled as just mentioned, a new or fresh V-shaped shed is formed, and at each shed formation the filling 32 is inserted across the shed with the beat up step ensuing. By this repetitive action, fabric formation continues. Beat up of the filling 32 with the warp sheets 16A and 16B to the fell of the fabric results from the action of a reed 40 connected on top of lay 42 which pivots at 44 for movement between forward and rear positions generally identified by arrow in FIG. 2. Reed 40 is a comb-like element which includes a plurality of vertical wires or dents which serve to guide the warp yarns 14 during their forward progress. After fabric F has been formed by the aforementioned beat-up step, it is advanced over roller 46, around suitable guide rolls 48, 50 and onto cloth take-up roll 52.

It is to be understood that the foregoing description of a conventional loom is presented herein as a preferred environment for features of the invention to be described next. The loom just described, being conventional, may include a variety of further features, known in the art, and only so many of the features thereof as will assist in a full and complete understanding of the present invention are set forth in the above description.

Figure 3:
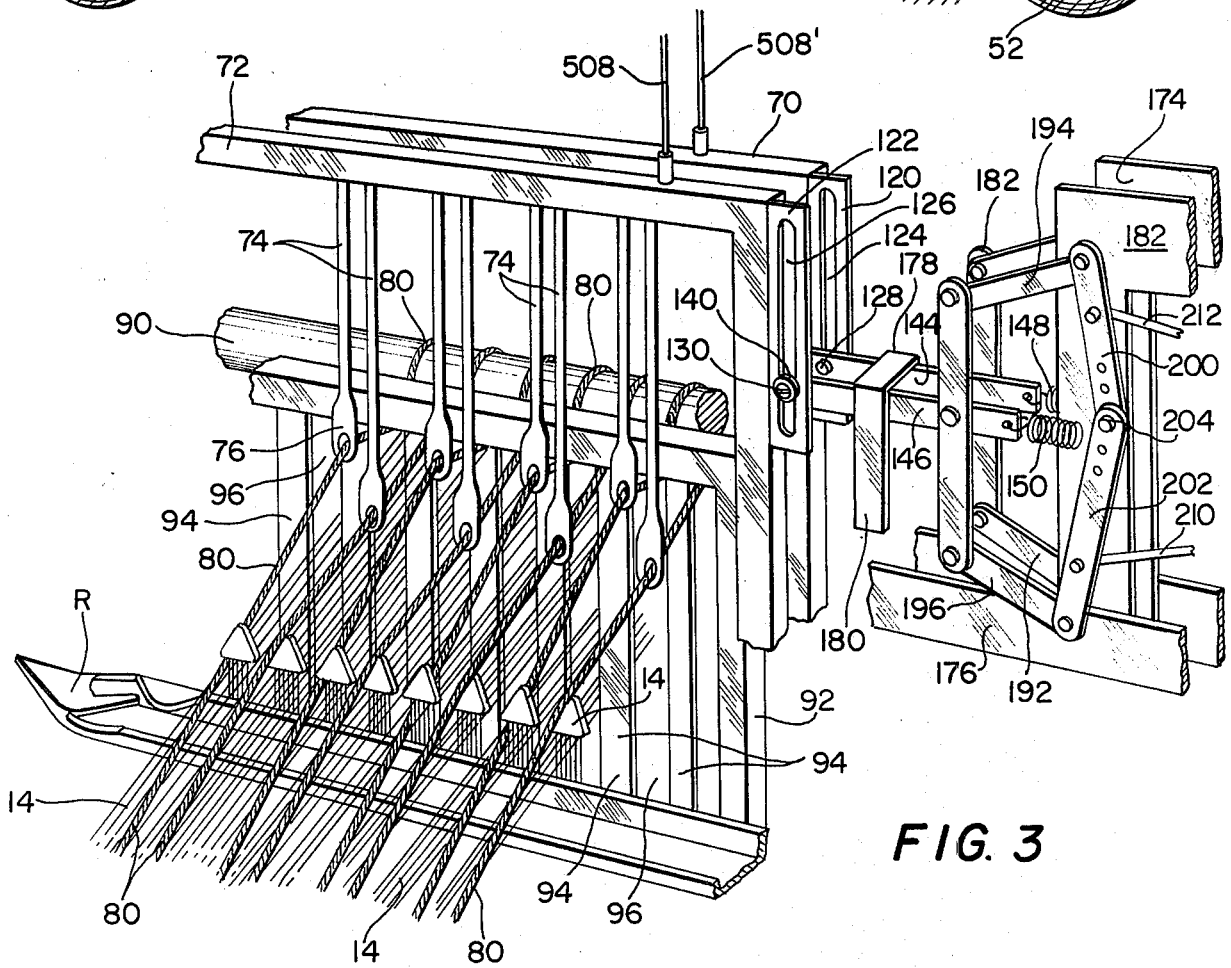
FIG. 3 is an enlarged perspective view illustrating details of the special harnesses of the present invention and mechanism for imparting lateral motion thereto.

As has aleady been discussed herein, the present invention includes mechanism for weaving patterns into fabrics during formation of the fabrics. Thus, in accordance with the present invention and with particular reference to FIGS. 1 through 3, a further pair of harnesses 70 and 72 are situated forwardly, i.e., to the right viewing FIG. 2, of harnesses 26, 28. Each harness 70 and 72 is provided with a series of depending rods or needles 74, the lower end of each needle being configured as a closed eyelet 76 through which an individual decorating warp yarn 80 of a plurality of such decorating yarns advancing from separate supply package 82 of such decorating yarns is threaded. Each supply package 82 is suitably mounted for the yarn thereon to be delivered over-end therefrom, with the plurality of decorating yarns passing as a common sheet sequentially over a series of guide ends 84 and 86, 88 and 90 during their advance toward and through eyelets 76 of needles 74. As seen in FIG. 1, the decorating yarns are guided between the heddles of harnesses 24, 26 but are not engaged with the eyelets of these heddles. As best seen in FIGS. 2 and 3, each separate decorating yarn 80 passes through an individual eyelet 76 of a respective needle 74 with every other one of the warp yarns 80 in the common sheet being threaded through a respective eyelet 76 in harness 70, and the intervening decorating yarn 80 in the common sheet passing through an eyelet 76 of harness 72. It will be evident that the decorating yarns 80 move in paths generally parallel to warp yarns 14 between their supply sources 82 and the fabric F except for a zone of deflection relative to warp yarns 14 which will be discussed hereinafter. Consequently, every other decorating yarn 80 is under the control of the same harness. Thus, as harnesses 70 and 72 are alternately raised and lowered, the decorating yarns under the control of each harness are similarly raised and lowered so that a secondary shed is formed by the decorating yarns superimposed on shedding zone 30 as seen in FIG. 2. Accordingly, as filling 32 passes through shedding zone 30, it likewise passes through the shed formed by decorating yarns 80. The effect on the movement of each harness 70, 72 in moving to its lower position is thus to project the decorating yarns engaged therein into the plane of shedding zone 30 so that upon the beat up motion of lay 42, the decorating yarns within shedding zone 30 will be interlocked in fabric F by filling 32.

Figure 9:
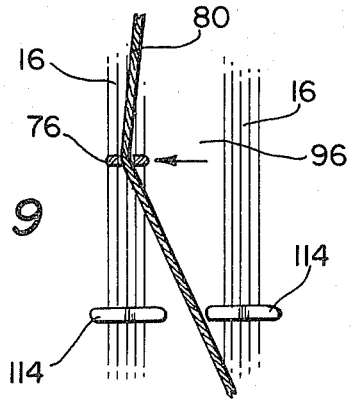
FIGS. 9 and 10 are fragmentary views, schematic in nature, illustrating in sequences paths assumed by the decorating yarns during the crossing over step relative to the warp yarns.
Figure 10:
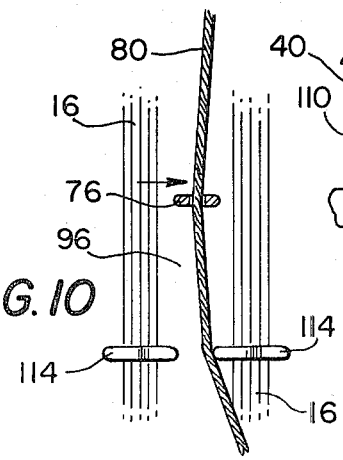

To the end that decorating yarns 80 may be extended downwardly into shedding zone 30 by needles 74 without disturbing or breaking the warp yarns 14, a stationary frame or comb 92 is located forwardly of harnesses 26, 28, i.e., to the right as viewed in FIG. 2, and rearwardly of harnesses 70, 72. As best seen in FIG. 3, comb 92 is provided with a plurality of vertically arranged ribs or spacers 94 equidistantly spaced to afforded clearance openings 96 therebetween. The warp yarns 14 are divided so that an equal number of warp yarns 14 pass through each opening 96. It will be apparent that at each locus where the warp yarns are deflected from their normal path of advance by spacers 94, an opening 96 corresponding in width to the transverse dimension of a spacer 94 will be provided as illustrated in FIGS. 9 and 10. As will be explained more fully hereinafter, harnesses 70, 72 are controlled so that as needles 74 thereof are projected downwardly to extend the decorating yarns 80 into shedding zone 30, the needles 74 are aligned with the several openings 96. Thereby, needles 74 and decorating yarns 80 pass freely into the shedding zone 30 without disruption of either the warp yarns 14 or decorating yarns 80.

Figure 11:
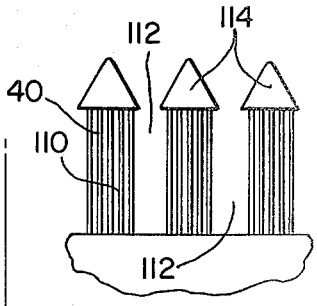
FIG. 11 is a detail view of a portion of the reed of the present invention.

Viewing FIG. 11, which is a detail view of a portion of reed 40, it will seem that the reed of the present invention is comprised of the usual dents 110 for receiving the plurality of warp yarns 14 and 80 after their advance through their respective harnesses and preliminary to beat up the filling 32 into the fabric. It will be noted in FIG. 11 that the dents 110, while generally enclosed at their upper extremes in the conventional manner, include slots 112 between certain dents which are open at their upper ends. The slots are equidistantly spaced and each slot 112 is generally aligned with a spacer 94 of comb 92. As the plurality of warp yarns 14 are threaded through reed 40, none of these particularly warp yarns are passed through the spaces 112. Rather, spaces 112 of reed 40 accommodate the warp yarns 80 advancing from packages 82, one warp yarn 80 entering each spacer 112 under the guidance of a given needle 74. Each needle 74 has a component of lateral motion which deflects a warp yarn 80 under its control from a normal straightline path essentially parallel to warp yarns 14, generally illustrated in FIG. 3, to a deflected path (FIG. 9), wherein the plurality of decorating yarn 80 overlay warp yarns 14. To insure that each decorating 80 enters the same opening repetitively as the harnesses 70 and 72 move downwardly to project these yarns 80 into the shedding zone 30, a wedge-shaped guide 114 is provided to assist in urging each particular zone 80 into alignment with its proper space 112 in reed 40.

It has already been discussed that decorating yarns 80 are under the control of harnesses 70 and 72 and, more particularly, that each harness 70, 72 is provided with depending needles having eyelets 76 at their lower ends through which the yarns 80 pass. Each of the harnesses 70, 72 is adapted for compound movement, that is, movement both laterally and horizontally. Such movement is imparted by control mechanism next to be described.

Figure 7:
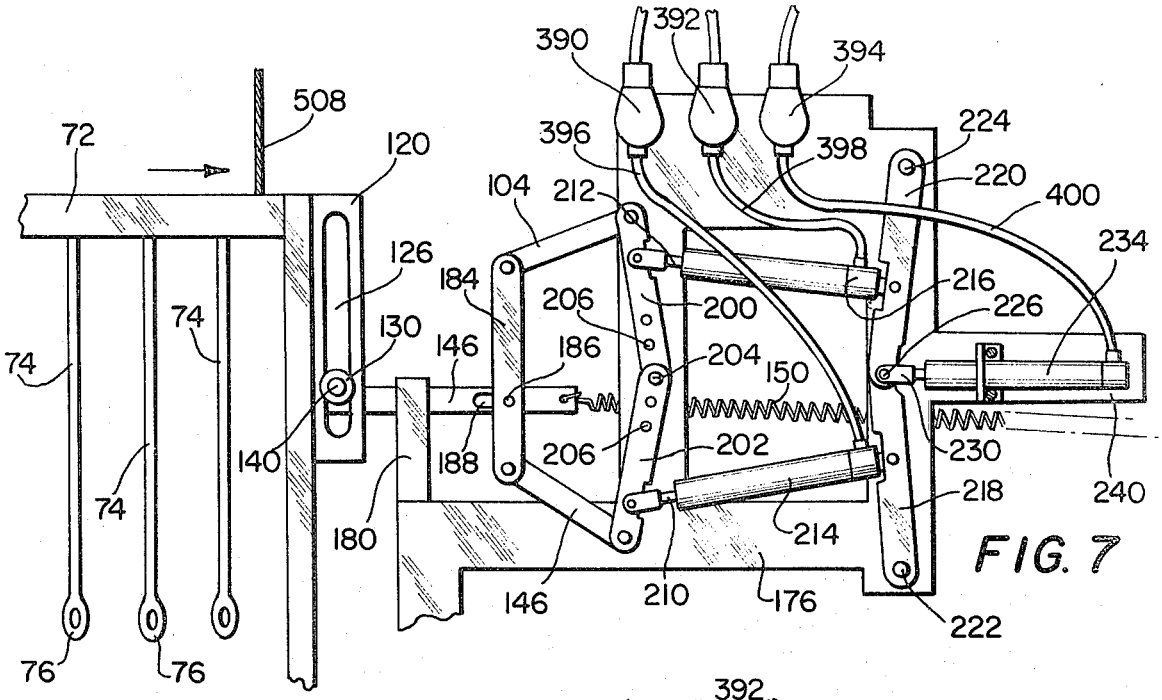
FIGS. 7 and 8 are similar front elevational views illustrating in sequence the operational positions of certain of the mechanism employed to impart horizontal reciprocating motion to the harnesses of FIG. 3.
Figure 8:
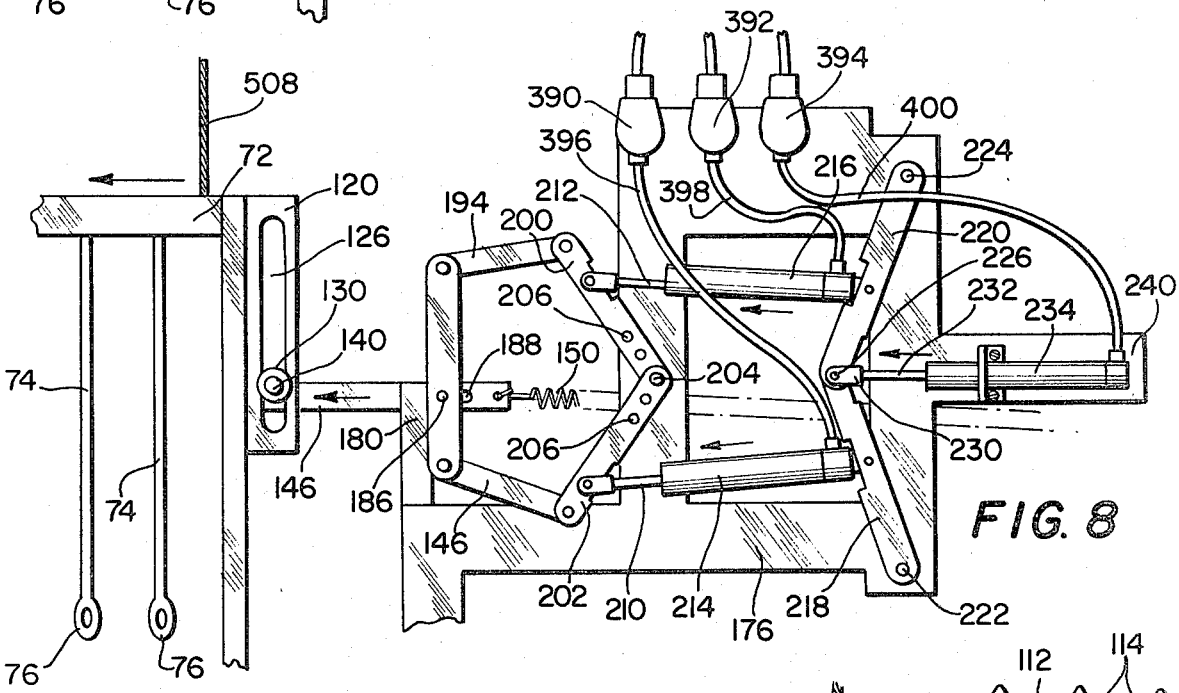

With attention in particular to FIGS. 3, 7 and 8 at this juncture, each harness 70, 72 is provided with a guide member 120, 122 secured to the side of its associated harness. Each member 120, 122 has an elonagated slot 124, 126 which receives a respective roll 128, 130 to be mounted in the slot for free up and down movement within said slot. As is evident in FIGS. 3, 7 and 8, the rolls 124, 126 are flanged so as to overlay the edges of the slot in which each is situated and thereby preclude the roll from riding out of its slot.

With continuing reference to FIGS. 3, 7 and 8, each roll 124, 126 is mounted on a stud 140, 142 for rolling engagement therewith. Each stud is fastened on one end of a rigid control bar 144, 146, respectively, with the opposite ends of these control bars being connected to individual elongated extension springs 148, 150. The opposite ends of springs 148 and 150 are connected to a remote point (not shown) on loom L.

Each control bar 144, 146 serves as a means for controlling swinging movement of its associated harness 70, 72 and further acts as the means to impart lateral or sideways motion to its harness. Mechanism is provided to shift each arm 144, 146 to effect such lateral movement and this will now be described.

At the outset of this section of the discussion, it will be of use to point out that the mechanisms for controlling the lateral motion of control bars 144, 146 are independent from each other. That is to say, each harness 70, 72 is provided with its own control mechanism. However, each mechanism is identical with the other. Thus, in the drawings where certain parts of one of the lateral shifting mechanisms are not seen, it is to be understood that such parts are identical with corresponding parts of the shifting mechanism which is illustrated and described.

Thus, the mechanism for controlling or effecting the shifting of each of the harnesses 70, 72 in a vertical plane is, in the main, supported on respective spaced apart rigid frames 174, 176 secured to the right hand side of loom L. The mechanism for harness 70 is supported on frame 174 and the similar mechanism for harness 72 is supported on frame 176. A pair of upstanding members 178, 180 are secured to frames 174, 176, respectively, with each member 178, 180 being slotted to afford free sliding movement of one of the control bars 144, 146 therethrough. Consequently, members 178, 180 act as guides for their associated arms. Each bar 144, 146 is under the control of a linkage arrangement which includes generally respective vertically oriented links 182, 184 connected to associated arms 144, 146. Connections between each control bar and its link is achieved via a stud 186 situated generally intermediate the opposite ends of its link, with each stud passing through a separate elongated slot 188 in each of the control bars 144, 146. The opposing outer ends of each link 182, 184 are connected with a pair of generally horizontally arranged links, being identified as 190 and 192 in the case of link 182 and 194, 196 with respect to link 184. The ends of these links 194, 196 remote from their associated links 182, 184 are connected with further links 200, 202, respectively. The ends of links 200, 202 remote from their connecting points with link 194, 196 are joined together for free rocking movement on a common stud 204 which is secured in frame 176. Each of the links 200, 202 has a plurality of holes 206 drilled therein so that the throw or degree of lateral shifting of harness 72 under the linkage system being described can be adjusted. In a like manner links 190, 192 are connected with links (not shown) corresponding to links 200, 202 and are secured at a common point on a stud (also not shown) corresponding to stud 204. It will be appreciated that the companion linkages just described are articulatable, that is to say, each link of each linkage is relatively free to rock with respect to its adjacent links to permit movement of arms 144, 146 in a back and forth vertical path between the positions shown in FIGS. 7 and 8.

Pistons rods 210, 212 of a pair of single acting air cylinders 214, 216 are connected, respectively, to links 200 and 202. As is typical with such single acting air cylinders, pressurized air is employed to extend piston rods 210, 212 and springs internally of the cylinders (not herein shown) are utilized to retract the pistons. The rear ends of cylinders 214, 216 are rockably mounted on a pair of associated links 218, 220 as seen in FIGS. 7 and 8. Link 218, in turn, is pivotally supported on a pin 222 while link 220 is similarly carried on a mounting pin 224. Links 218 and 220 are joined for relative movement at their ends opposite from their pins 222 and 224 via a stud 226. This same stud 226 passes through a clevis 230 carried on the outer end of a piston rod 232 of a single acting air cylinder 234 which is fixedly supported in a bracket 238 on an extension 240 of frame 176. Air cylinders 214, 216 and 234 may be the same type of manufactured and sold by Humphrey Products, Kalamzoo, Michigan, as No. 7-SP2 for cylinders 214, 216 and No. 7-SP1 ½ for cylinder 234. While in the foregoing discussion, on the linkage and motive means for operating arm 146 has been fully detailed, it is to be understood that a companion arrangement identical to that just described is provided for operating arm 144, this companion arrangement being supported on frame 174 in the same manner as frame 176 is employed for the linkage and motive means for control bar 146.

Figure 4:
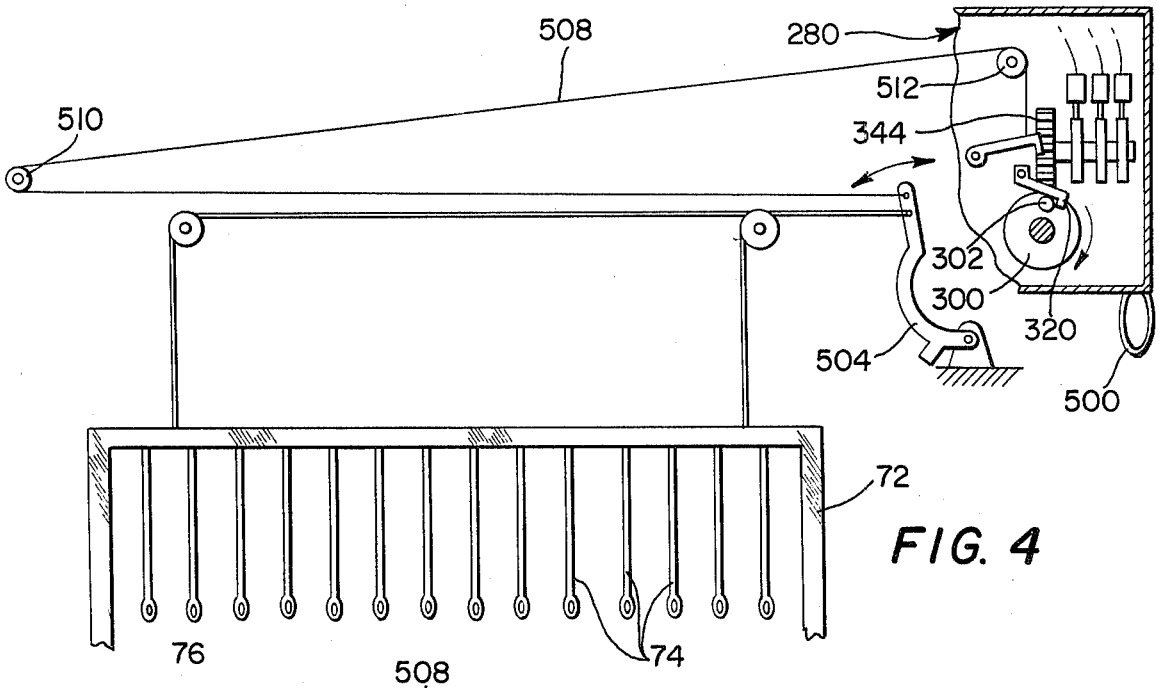
FIG. 4 is a front elevational view of one of the harnesses of FIG. 3 and illustrating features of the mechanism for imparting reciprocating vertical motion to said harnesses.
Figure 5:
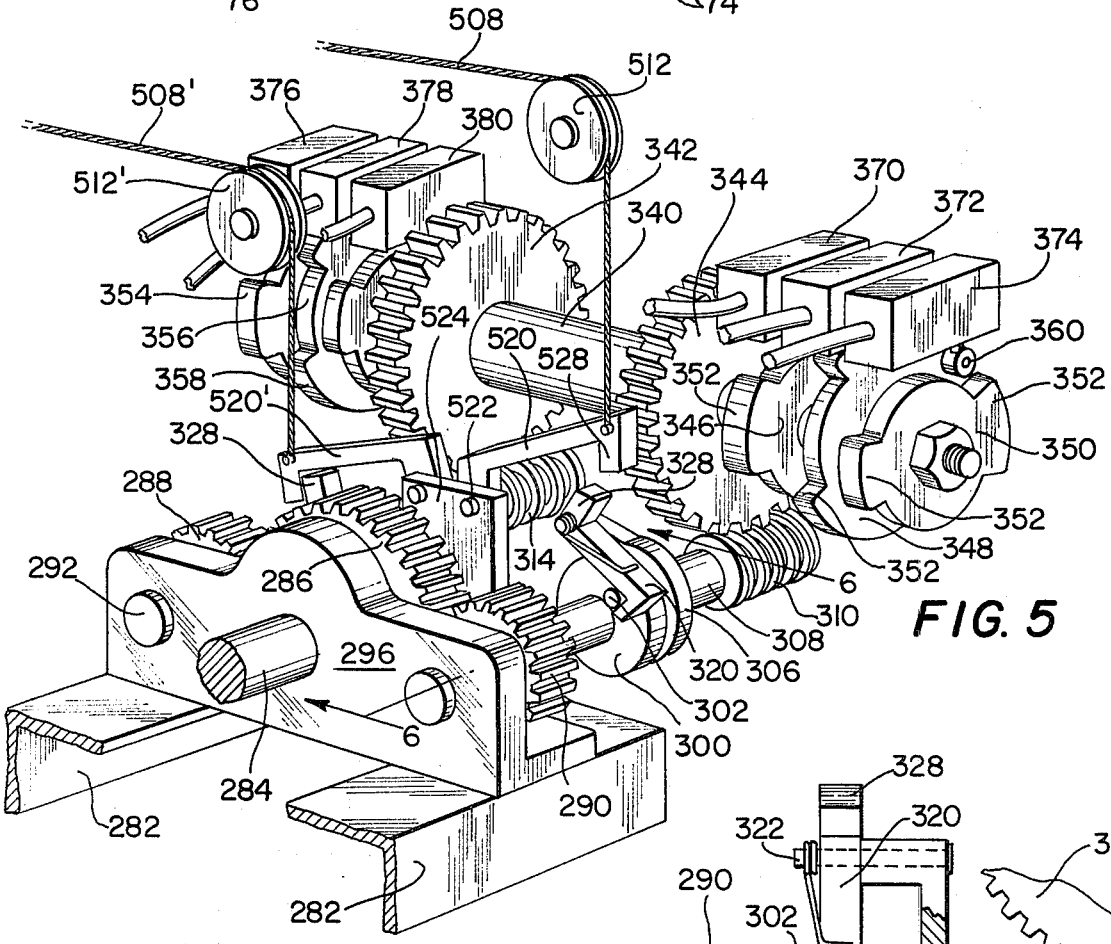
FIG. 5 is an enlarged perspective view of further features of the mechanism for controlling the reciprocating horizontal and vertical motions of the harnesses of FIG. 3.
Figure 6:
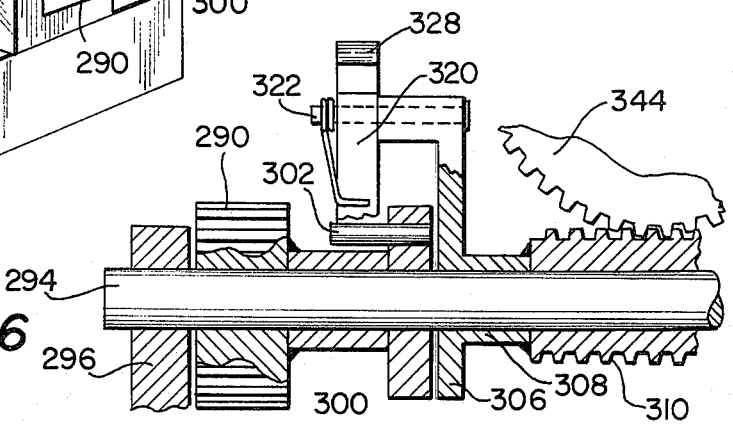
FIG. 6 is an enlarged detail view taken along lines 6—6 of FIG. 5.

At this point it will be somewhat apparent that air cylinders 214, 216 and 234, together with the related linkages, operate to impart lateral motion to harness 72. The control for these several air cylinders will next be discussed. Thus, as best seen in FIGS. 4, 5 and 6, loom L is equipped with a conventional top motion 280 supported on appropriate framework 282 in more or less conventional fashion and serving to control harnesses 26, 28, 70 and 72 for up and down reciprocating motion cooperatively with spring mechanisms at the lower ends of the harnesses, not shown. The top motion 280 may be constituted as a dobby mechanism of the type manufactured and sold by Staubli Brothers and Co., Horgen, Switzerland, as Type Leck de 22 DA, Order No. 18652-85. Such mechanism includes a drive shaft 284 which has a drive gear 286 fixed thereon for rotation therewith. Shaft 284 is driven from the main motive means for the loom, such as an electric motor, and is operated continuously with the loom. A pair of spur gears 288, 290 are fixed on respective stub shafts 292, 294 for rotation therewith. The outer ends of shaft 284 and stub shafts 292, 294 are supported for rotation in suitable bearings in an upstanding bracket 296 mounted on framework 282. The inner ends of each of the stub shafts 292, 294 have a drive 300 secured thereon (only one driver being visible in FIG. 5). A driving lug 302 is set fast into the sidewall of each driver 300 for purposes next to be described.

Viewing FIGS. 5 and 6, it will be seen that shafts 292 and 294 each serve to loosely receive an integral assembly which, in the case of shaft 294, includes a driver disk 306 integrally formed with a sleeve 308 and a worm gear 310. Of the parts visible in FIG. 5, shaft 292 includes a like assembly with a sleeve 312 and worm gear 314 being shown. Disk 306 of shaft 294, and the similar disk (not shown) on shaft 392, each are provided with a driving dog 320 affixed on the periphery thereof and extending in a plane to overlay lug 302. Each dog 320 is rockably mounted on a pin 322 and is provided with a spring 324 acting to bias the dog downwardly into engagement with its mating lug 302. The rear end of each dog 320 is upturned to form a projection 328 for purposes to be discussed herinafter.

With continuing attention in particular to FIG. 5, a support shaft 340 resides in a position above shafts 292, 294 and is oriented at right angles to these latter two shafts. A pair of mating drive gears 342, 344 are loosely supported on shaft 340 for independent rotation from each other. Suitably connected to gear 344 for rotation therewith are three disc cams 346, 348 and 350 provided with the usual lobes 352 at spaced apart locations around the periphery of the cams. Similarly, gear 342 has three cams 354, 356 and 358 ganged together for rotation with said gear 342. Thereby when worm gear 310 is rotated, drive gear 344 and its companion cams 346, 348 and 350 are likewise rotated. In the same manner, when drive gear 342 is rotated, the cams 346, 348, 350, ganged with gear 342, are rotated.

Each gang of cams, namely cams 346, 348, 350 and cams 354, 356, 358 are aligned with the actuators 360 of associated electrical switches 370, 372, 374, 376, 378 and 380. Said electrical switches 370–380 are the same as Style No. 2RW822A2 manufactured and sold by Microswitch, a division of Honeywell, Freeport, Illinois. As either gang of cams is rotated by its drive gear 342 or 344, the lobes on the cams strikes the actuators 352 of the associated electrical switches. Each of the electrical switches 370–380 is connected with an associated remotely controlled electric air valve of a plurality of such valves. In FIGS. 7 and 8 air valves 390, 392 and 394 are illustrated while the companion set of valves for harness 70 are not seen but are, of course, the same as valves 390–394. Valves 390–394 may be the same as Item No. 20463-1115 sold by A. Schrader and Sons, Brooklyn, New York. Said valves 390, 392 and 394 are opened upon the application of an electrical signal to admit pressurized air from a suitable air supply source via lines 396, 398, 400 to air cylinders 214, 216 and 234, respectively. Upon loss of the electrical signal to the valves 390–394, they operate to shut off the air supply to their respective cylinders 214, 216 and 234 and permit the compressed air in those cylinders to be dumped to atmosphere. For purposes of this discussion, it can be assumed that valves 390, 392, 394 are under the control of cams 346, 348, 350, respectively, and their related switches 370, 372, 374, with valves 390–394 being operable to initiate certain movements to harness 72. As has already been emphasized, switches 376, 378, 380 control a further set of solenoid operated air valves identical to valves 390–394 to actuate certain motions of harness 72 via control bar 144.

The mechanisms just described are operable to impart periodic lateral motion to harnesses 70, 72 and such periodicity is accomplished in the following manner. The dobby 280 includes sprocket driven pattern cylinder or card 500 which, in the known manner, is provided with a series of holes which are sensed by indicating wires to initiate movement of jacks, one of which is shown at 502 in FIG. 4 to normally impart vertical motion to the loom harnesses via a harness cord 506. Viewing FIGS. 4 and 5 wherein harness 72 is illustrated, it will be seen that jack 502 of dobby 280 not only has the usual cord 506 attached thereto and to harness 72 but, further, a latch-operating end 508 extends from its connecting point with jack 504, around sheaves 510 and 512 and connects with a rockable pawl 520 loosely supported on a pin 522. In turn, pin 522 is engaged in a post 524 positioned generally mid-way between shafts 292 and 294 and supported at its base on framework 282. Pawl 520 has a depending hook 528 at its forward end which is aligned for engagement with projection 328 of dog 320. When pawl 520 is held in an elevated position by cord 508, dog 320 is free to fall under the force of gravity into engagement with lug 302 of driver 300. Since driver 300 is contantly rotating, disc 306, which is locked into engagement with driver 300, is driven to impart rotation to worm gear 310. This, in turn, causes gear 344 and its cam assembly 346, 348, 350 to rotate so that the lobes of the cams operate to engage actuators 350 of switches 370–374 whereby the contacts of said switches are closed to pass electricity to solenoid valves 390–394. In consequence thereof, compressed air is admitted to cylinders 194, 196 and 234 to thrust harness 72 to the left, viewing FIGS. 4, 7 and 8. Upon operation of the dobby 280 to lower harness 72 to move needles 74 into shedding zone 30, jack 504 rocks counterclockwise, viewing FIG. 4, thereby slackening cord 508 to a degree permitting pawl 520 to drop into the rotational path of projection 328 of dog 320. As projection 328 rotates into engagement with the hook 528 of pawl 520, dog 320 is rocked out of engagement with lug 302 and the rotation of worm gear 310 ceases. Since electrical energy is then not flowing to solenoid operated air valves 390–394 (the timing of the halting of worm gear 310 having been selected to halt the cams with actuators 360 removed from engagement with any of the cam lobes) the valves operate to automatically dump the air out of cylinders 214, 216 and 234 whereupon the biasing springs within said cylinders supplemented by spring pressure from spring 150 will return harness to its rightward position as depicted in FIG. 7.

It is to be understood that an arrangement is provided for harness 70 identical to that just described for harness 72. While all of the parts for controlling the harness 70 are not illustrated in FIG. 5, harness cord 508' connects to harness 70 and passes over sheave 512' to connect with pawl 520'. Thus, harness cord 508' is operative with pawl 520' to control the output of switches 376–380 which, in turn regulate solenoid valves similar to valves 390–394 to control the motion of arm 144 in the same manner as arm 146 is controlled by means just described in detail.

The operation of the improved apparatus of the present invention will be more or less evident from the foregoing description. To facilitate a full and complete understanding of such operation, a brief operational summary will be presented next. Firstly, let it be assumed that the loom L is threaded up in the manner illustrated in FIGS. 1 and 2. That is to say, the sheet of warp yarns 14 is drawn from supply beam 12, led through appropriate eyelets in the heddles of harnesses 26, 28 in conventional manner for such looms to provide two separate sheets of warp yarns 16A and 16B, the warp yarns then being threaded through reed 92 and ultimately being interlaced with filling 32 in shedding zone 30 to form fabric F. Warp yarns 14 may be of any type of suitable strand material adaptable for weaving, of either natural or synthetic fibers or blend. As seen in FIGS. 1 and 2 decorating yarns 80, which are actually additional warp yarns, and also which may be of any suitable type, are drawn off over end from conical supplies 82, led between heddles (but not through the heddle eyes) of harnesses 24, 26 then through eyelets 76 of depending needles 74 of harnesses 70, 72 to be eventually interwoven into fabric F. As has been explained earlier, alternating decorating yarns 80 are engaged in a first of the harnesses 70, 72 with the intervening decorating yarns of the sheet being engaged in the other of the harnesses 70, 72. In the usual manner well known to those skilled in the art of weaving, the sequencing of harnesses 26, 28 is programmed into dobby 280 via pattern cylinder 500. In accordance with the present invention, such program not only includes the sequencing of harnesses 24, 26 but, also includes the operation and the sequencing of harnesses 70, 72. Coincident with the programming of dobby 280, the control cams 346, 348, 350, 354, 356 and 358 are selected and arranged in a manner to shift harnesses 70, 72 laterally in proper timing with respect to each other and with respect to the rate of fabric formation to effect the desired crossing over of the decorating yarns 80 with respect to warp yarns 14 and consequently, the pattern to be woven by the decorating yarns. Two additional steps are necessary in the present weaving apparatus as preliminaries to commencement of the weaving cycle. After the fabric design has been determined and the number of warp yarns 14 to be crossed over by decorating yarns 80 has been established, a comb 92 arranged with spacers 94 to provided openings 96 corresponding to the width of the pattern to be formed by decorating yarns 80 is selected and installed in position as previously described. Similarly a reed 40 having spaces 112 generally equidistant to those in comb 92 and aligned with the spaces 96 of the comb is installed on lay 42 in the known manner.

With loom L so threaded and arranged, the main loom drive, which may be an electric motor not shown, is energized to motivate the loom whereupon warp yarn 14 and decorating yarns 80 are interlaced with filling 32 in shedding zone 30 and then beat up by reed 40 to the fill of the fabric, with the fabric being taken up on cloth roll 52. The interlacing of warp yarns 14 and filling 32 is conventional and well understood. However, further discussion of the weaving of the decorating yarns 80 into the fabric may be of assistance to a full and complete understanding of the invention.

In the interest of presenting a relatively concise description of the interweaving of the decorating yarns 80 into fabric F, let it be assumed that the decorating yarns 80 controlled by harnesses 70, 72 are simply to cross over an equal number of warp yarns 14, and that the decorating yarns 80 in harnesses 70, 72 are regularly alternate with each other in being projected into shedding zone 30. That is to say a simple cross over pattern effected by a repetitive left-right-left motion of each of the harnesses 70, 72 is to take place. Of course, the present invention is not so limited and it can readily be understood that harnesses 70, 72 could be programmed by the control mechanisms disclosed herein to provide an infinite number of patterns by the decorating yarns. For example, the harnesses could easily be programmed for left-left-right-right lateral motions which would insert a pattern in fabric clearly differing from the simpler left-right-left side to side motion. Furthermore, additional harnesses constructed and controlled similar to harnesses 70, 72 could be provided if desired.

It will be recalled that dobby 280 of the present invention includes the series of cams 346–350 and 354–358. Consequently, as card 400 of dobby 280 functions to raise and lower harnesses 70, 72 in the known manner, the several cams just mentioned are periodically rotated in response to the delatching of pawls 520, 520' to permit driving dogs 328 to initiate rotation of the power train to either cams 346–350 or 354–358. Since the harnesses will only be shifted laterally when they are in their raised positions, their controlling cams are designed to admit air to the air cylinders controlling the linkages only when the harnesses are in their raised positions. The operation of both harnesses 70, 72 is the same. Thus, reference at this juncture will be made only to harness 72, it being understood that harness 70 would remain in its elevated or raised position during downward movement of harness 72 so that the yarns controlled by harness 70 are held in a plane above warp yarns 14 with the two sheets of yarns 80 in heddles 70, 72 forming a shed somewhat superimposed on shedding zone 30. Upon a signal from dobby 280, harness 72 is raised to be clear of all warp yarns 14 in shedding zone 30. Cams 346–350 are rotated to initiate switches 370–374 in a sequence so that air is first admitted to extend piston rod 232 of cylinder 234. Next, rods 210, 212 of cylinders 214, 216 are extended. This sequential mode of operation is utilized to reduce the inertia of harness 72. At this point in time, the decorating yarns 80 will be extended to a point beyond the actual vertical path where they are to be projected downward into shedding zone 30. This over-extended position, shown in FIG. 9, is to insure that decorating yarns reside on the proper side of guides 114 for entry into the correct spaces 112 of reed 40. As the yarns 80 are so extended to the position of FIG. 9, harness 72 begins to move downward by the action of dobby 280. Simultaneously with the commencement of this downward movement, the cam controlling the pressurized air to cylinder 234 rides out of contact with its actuator thereby deenergizing solenoid valve 394 and permitting the air in cylinder 234 to be dumped to atmosphere. However, cylinders 214, 216 remain charged. Thus, harness 72 moves rightwardly, viewing FIG. 10, under the influence of spring 150, to an intermediate position between its left and right hand extremes where the eyelets 76 of each of the needles 74 of harness 72 are disposed as the harness simultaneously moves downwardly, In this projecting position eyelets 76 and the yarns 80 therein are aligned with slots 112 and the openings 96 through the sheets of warp yarns 14. As has already been indicated, the decorating yarns, at this time, cannot slide over the top of the elevated tip of guides 114 since the downward movement of harness 72 coupled with concurrent rightward movement of the harness; view FIGS. 9 and 10, has carried the decorating yarns into the horizontal plane of guides 114, and, thus, decorating yarns 80 are, as just mentioned, properly aligned for entry into slots 112 of reed 40 and through the sheet of warp yarns 14. As harness 72 continues its downward movement, needles 74 are, of course, shifted downwardly in concert therewith under the control of dobby 280 and cooperating springs. With the needles downward the decorating yarns 80 in eyelets 76 are projected into shedding zone 30 as best seen in FIG. 2. Rapier R is then operated to carry filling 32 through the shedding zone, beat-up to lock the decorating yarns 80 and warp yarns 14 into fabric F as an integral part of the fabric. At this time, and consistent with the weaving pattern herein being described, harness 72 is lifted to its raised position. The air in cylinders 214, 216 is vented by deenergization of solenoid valves 390, 392 as a result of the release of the switch actuators 360 of switches 370, 372 by cams 345, 348 and harness 72 is returned to its right-hand position as illustrated in FIG. 7 under the combined pressure of spring 150 and the springs interiorly of cylinders 214, 216 to await its next cycle. The complete retraction of pistons 210, 212 in their cylinders acts as a stop for the rightward movement of harness 72. In the meantime, like mechanisms and components as just described and associated with harness 70 will be operated to move said harness 70 through a cycle the same as that described for harness 72 with harness 72 thereupon being retained in its raised position. Adjustment of the degree of lateral shifting of each harness 70, 72 achieved via setting of stud 204 in the proper holes 206 of lines 200 and 202.

Figure 12:
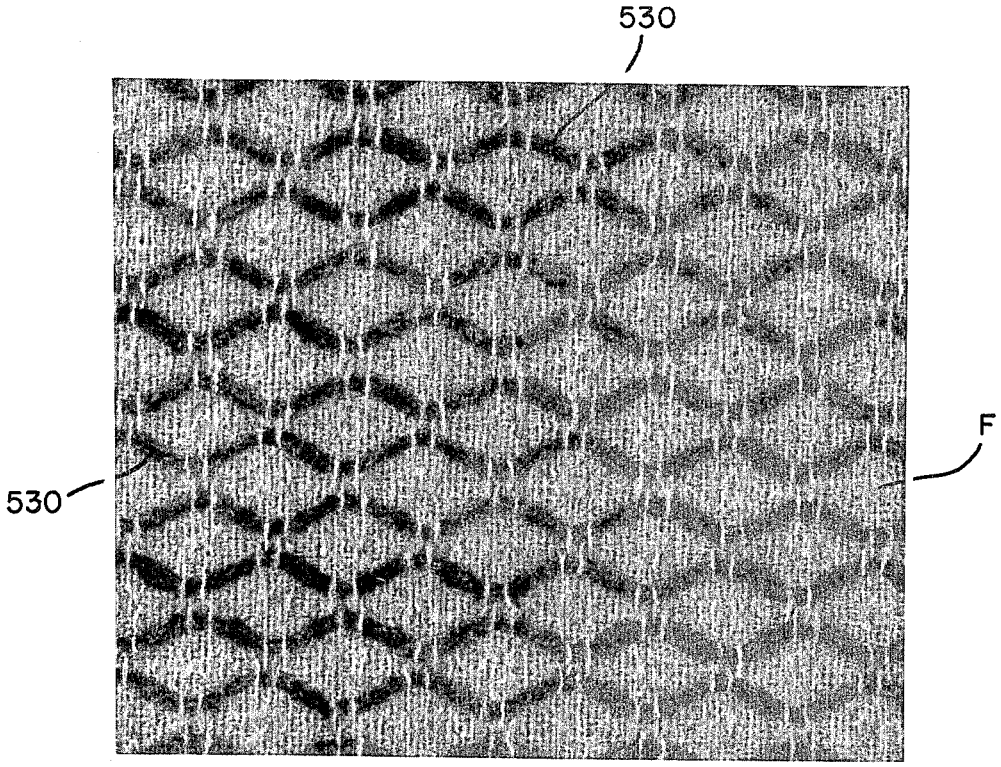
FIGS. 12 and 13 are photographs of the top surfaces of fabrics possessing decorative patterns woven in accordance with the present invention.
Figure 13:
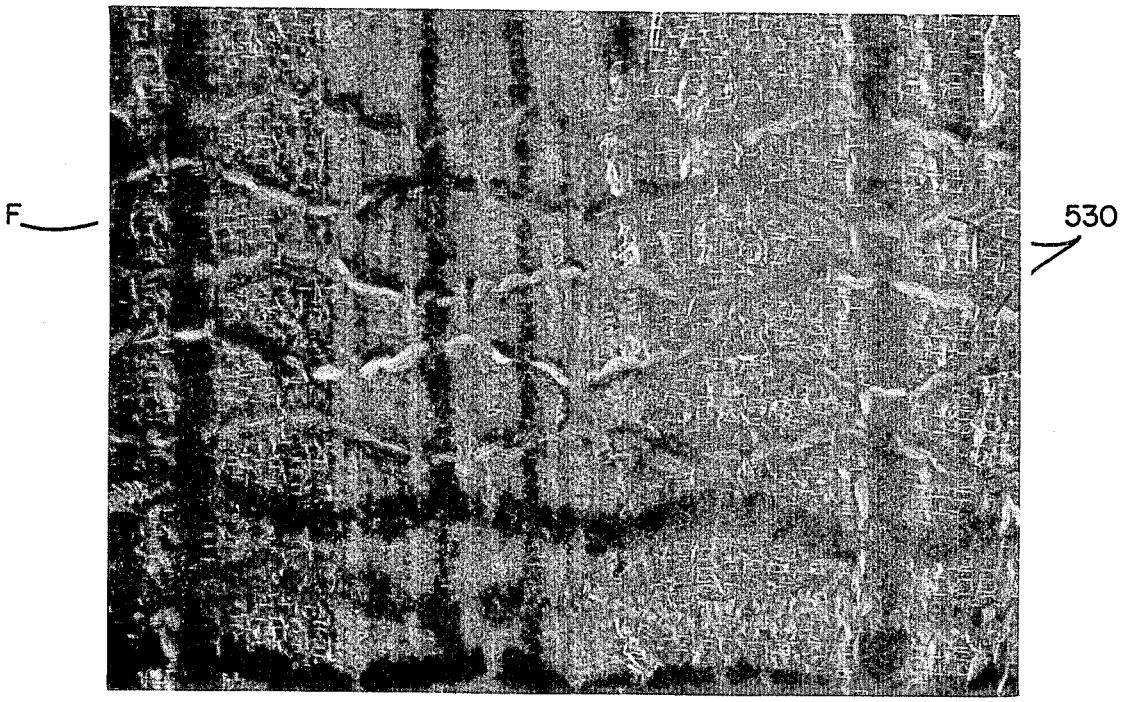

It will be appreciated that the operation of the loom L as just described, and particularly harnesses 70, 72 thereof, is relatively simple. It is readily within the skill of those knowledgeable with the art of weaving to program the motions of harnesses 70, 72 to develop a wide variety of designs in fabrics being woven on loom L by regulating the motions and timings of harnesses 70 and 72 to produce a wide variety of designs in fabrics being woven on loom L by regulating the motions and timings of harnesses 70 and 72 to produce a wide variety of patterns in fabrics woven on the loom. The photographs in FIGS. 12 and 13 are but two representations of different patterns 530 producible in conjunction with fabric F woven on loom L.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a loom means for advancing a plurality of warp yarns in generally parallel paths through said loom for weaving into fabric, and means for deflecting said warp yarns in diverging planes during their advance to form a shedding zone through which filling yarn is projected for interweaving with said warp yarns during subsequent beat up by a reed to the fell of the fabric being woven on the loom, the improvement comprising: a plurality of decorating yarns advancing through the loom to the fabric in paths at least a portion of which are generally parallel to said warp yarns, harness means for engaging said decorating yarns, and means for operating said harness means in a predetermined sequence to shift said decorating yarns controlled thereby from a first position residing generally parallel with said warp yarns to a second position where said decorating yarns are displaced laterally from said warp yarns, said operating means thereafter shifting said harness means in a direction to dispose said decorating yarns in a third position overlaying a preselected number of said warp yarns and thereafter projecting said decorating yarns to a fourth position within said shedding zone for binding into said fabric during beat up of said filling yarn, said harness means including at least first and second harnesses, each said harness being adapted to engage a predetermined group of said plurality of decorating yarns.

2. Apparatus as set forth in claim 1 including means for operating said first and second harnesses in a predetermined sequence to shift the decorating yarns controlled by one of said harnesses sequentially between said first, second, third and fourth positions while maintaining said second harness in a remote position to retain the decorating yarns therein spaced from the plane of said warp yarns.

3. Apparatus as set forth in claim 1 wherein said reed is at least partially open along its top edge to admit said decorating yarns into preselected dents of said reed as said decorating yarns are moved to said fourth positions.

4. Apparatus as set forth in claim 3 including guides positioned along the top edge of said reed for guiding said decorating yarns into said preselected dents.

5. Apparatus as set forth in 1 wherein each said harness is provided with a series of depending needles each having a yarn-receiving eyelet proximate the lower end thereof for receiving at least one decorating yarn therein.

6. Apparatus as set forth in claim 1 including means for moving each said harness in a predetermined sequence to shift the decorating yarns controlled thereby generally horizontally between said first, second and third positions and generally vertically between said third position and said fourth position.

7. Apparatus as set forth in claim 6 including a comb-line member having spacers arranged to provide separations between groups of warp yarns in said shedding zone, said separations being aligned with the path of movement of said decorating yarns from said third positions to said fourth position.

8. Apparatus as set forth in claim 6 including a dobby mechanism having program means therewith for initiating a signal output to operate each of said harnesses.

9. Apparatus as set forth in claim 8 wherein said program means is operable to provide a series of signals to sequentially operate motive means for moving each of said harnesses to situate the decorating yarn controlled thereby in said second, third and third positions.

10. Apparatus as set forth in claims 9 including cam means for providing said signals in a predetermined sequence for operating said motive means.

11. Apparatus as set forth in claim 10 wherein said signals are electrical signals and said motive means include pneumatic means.

12. Apparatus as set forth in claim 11 wherein said pneumatic means includes a plurality of pneumatic cylinders connected with each of said harness means.

13. Apparatus as set forth in claim 10 including clutch means for engaging a driven member with a driving member to effect movement of said cam means for actuating switches to provide said electrical signals.

14. Apparatus as set forth in claim 13 wherein said cam means includes a plurality of rotatable cams, each said cam being operable to provide a separate electrical signal to operate a related pneumatic cylinder, a first pneumatic cylinder be actuatable to move the harness with which it is connected to shift said decorating yarns therein from said first position to said third position, and a second pneumatic cylinder being operable to move said harness with which it is associated from said third position to said second position.

15. Apparatus as set forth in claim 14 including spring means for moving each said harness to shift the decorating yarn therein from said second position to said third position and from said third position to said first position.

16. Apparatus as set forth in claim 15 including means for adjusting the degree of vertical movement of each said harness.

17. Apparatus for operating harness means in a loom adapted to have a sheet of warp yarns advancing therealong in generally parallel paths to be woven into fabric comprising, operating means for moving said harness means laterally of said sheet of warp yarns from a first position above said sheet of warp yarns to a second position and thereafter shifting said harness means from said second position to an intermediate position between said first and second positions, said operating means including electrical means operable in a predetermined sequence for activating pneumatic means connected with said harness means and means for moving said harness means generally vertically relative to said sheet of warp yarns simultaneously with shifting of said harness means to said intermediate position.

18. Apparatus as set forth in claim 17 wherein said harness means includes first and second harnesses.

19. Apparatus as set forth in claim 18 wherein each said harness is arranged with a plurality of needles engageable with supply yarns, said needles being projected below the plane of said warp yarns as said harnesses move vertically downward toward said warp yarns to thereby extend said supply yarns below at least a portion of said warp yarns.

20. A method of operating a loom wherein a plurality of warp yarns are advanced in generally parallel paths through said loom for weaving into fabric with the warp yarns being deflected in diverging paths during their advance to form a shedding zone through which filling yarn is projected for interweaving with said warp yarns during beat up by a reed to the fell of the fabric being woven on the loom, comprising the steps of: advancing a plurality of decorating yarns through the loom to the fabric in paths at least a portion of which are generally parallel to said warp yarns, shifting the decorating yarns when proximate to said shedding zone initially to first positions extending beyond a predetermined number of warp yarns and then to positions over said predetermined number of said warp yarns, and thereafter projecting said decorating yarns to a position within said shedding zone for binding into said fabric during beat up of said filling yarn.

21. The method as set forth in claim 20 including the step of dividing said decorating yarns into a plurality of groups, and shifting each group individually and in a predetermined sequence to said positions overlaying said warp yarns and then into said shedding zone for engagement by said filling yarn while retaining the remaining groups in a plane remote from said warp yarns.

22. The method as set forth in claim 21 including the step of simultaneously projecting said decorating yarns toward said shedding zone as said decorating yarns are returned from said extended positions to said positions overlaying said predetermined number of warp yarns.

23. The method as set forth in claim 21 including the step of guiding said decorating yarns into the dents of said reed concurrently with projecting said decorating yarns into said shedding zone.

24. The method as set forth in claim 20 including the step of providing openings between said warp yarns for passage of said decorating yarns into said shedding zone.

25. The method according to claim 20 including the step of providing said decorating yarns wherein at least one said decorating yarn is diverse from the remainder of said decorating yarns.

26. In a loom adapted to have a sheet of warp yarns advancing therealong in generally parallel paths to be woven into fabric, the combination comprising, a reed through which the warp yarns advance, said reed having upstanding guide means projecting upwardly therefrom, harness means carrying a plurality of supply yarns, means for moving said harness means laterally of said sheet of warp yarns to carry said supply yarns from a first position above said reed and proximate to one side of said guide means to a second position above and proximate the opposite side of said guide means, means for shifting the harness means from said second position to an intermediate position between said first and second positions where each of said supply yarns is moved into contact with the opposite side of said guide means, and means for moving said harness means generally vertically relative to said sheet of warp yarns simultaneously with shifting said harness means to said intermediate position to thereby move said supply yarns toward said sheet of warp yarns while guiding said supply yarns along said opposite side of said guide means.

27. Apparatus as set forth in claim 26 wherein said guide means include a guide associated with each respective supply yarn.

28. Apparatus as set forth in claim 27 wherein each harness is provided with a plurality of needles engagable with said supply yarns, said needles being projected below the plane of the warp yarns as said harnesses move vertically toward said warp yarns to thereby extend said supply yarns below at least a portion of said warp yarns.

29. Apparatus as set forth in claim 27 wherein said harness means includes first and second harnesses, and including means for operating said first and second harnesses alternately between said first, second and intermediate positions in a predetermined sequence.

30. Apparatus as set forth in claim 29 wherein said harness moving means includes electrical means operable in a predetermined sequence for activating pneumatic means connected with each said harness.

* * * * *